US006448887B1

(12) United States Patent
Martin et al.

(10) Patent No.: US 6,448,887 B1
(45) Date of Patent: Sep. 10, 2002

(54) TWO-STAGE ALARM APPARATUS AND METHOD

(75) Inventors: Bradley Martin, Austin, TX (US); Francis Galea, Kemps Creek NSW (AU)

(73) Assignee: Befume Pty Limited, Mount Druitt NSW (AU)

( * ) Notice: Subject to any disclaimer, the term of this patent is extended or adjusted under 35 U.S.C. 154(b) by 0 days.

(21) Appl. No.: 09/537,040

(22) Filed: Mar. 28, 2000

(51) Int. Cl.[7] ..... G08B 1/00

(52) U.S. Cl. ..... 340/309.4; 340/309.15; 340/309.4; 340/825.19; 368/1; 368/10

(58) Field of Search ..... 340/309.15, 309.4, 340/511, 517, 523, 526, 825.19; 368/1, 10

(56) References Cited

U.S. PATENT DOCUMENTS 5,365,494 A * 11/1994 Lynch ..... 368/10

5,554,967 A 9/1996 Cook et al. ..... 340/309.15

* cited by examiner

*Primary Examiner*—Daryl Pope

(74) *Attorney, Agent, or Firm*—J. Nevin Shaffer, Jr.; Shaffer & Culbertson LLP

(57) ABSTRACT

A two-stage alarm (10) includes a clock generator (36). A memory device (28 and 30) for storing data is connected to the clock generator (36). A data display device (22) is connected to the memory device (28 and 30) for displaying stored data. An alarm is connected to the memory device (28 and 30) with a first stage and a second attenuated stage. An alarm control device (24) is connected to the alarm for controlling the alarm in the absence of an alarm event and for selecting the second attenuated stage during an alarm event. As a result, the user of the two-stage alarm (10) can acknowledge an alarm event only by selecting an attenuated, reduced, alarm stage for a period of time and then manipulate the alarm only in the absence of an alarm event.

20 Claims, 5 Drawing Sheets

TWO-STAGE ALARM APPARATUS AND METHOD

BACKGROUND OF THE INVENTION

This invention relates to an improved alarm for signaling alarm events. In particular this invention relates to a two-stage alarm for signaling a user of an alarm event and allowing the user to acknowledge the alarm event without enabling the user to disable the alarm.

A variety of so called alarm watches are known in the art. Fatton, U.S. Pat. No. 4,187,671 discloses a "reaction" timer watch that is utilized to determine the ability of an individual to operate machinery such as an automobile. If an individual is unable to press a button as fast as the predetermined memory says the user should be able to, a message such as "do not drive" is displayed.

Komatsu, et al., U.S. Pat. No. 4,246,651 requires a user to input a matching count value when an alarm is generated or hold a button down for an appropriate period of time in order to shut off the alarm. Other patents, Thinesen, U.S. Pat. No. 5,063,544 and U.S. Pat. No. 5,226,022, disclose mechanisms whereby an alarm time may be modified without interrupting the normal function of the watch. Further, Oogita, U.S. Pat. No. 5,065,084 discloses a mechanism for estimating the lifetime of a battery driven device. In Oogita, a timer records the time when a battery is initially installed in the device and then an estimate is provided for current consumption during on time and off time.

Various types of alarms are disclosed in the prior art as well. Becker U.S. Pat. No. 5,861,797, for example, discloses a programmable watch for use with children with ADHD. The device provides a tactile alarm and then displays a number of preprogrammed messages. One or more of the messages may relate to the time to take medication.

With regard to "medication" alarms per se, Johnston, U.S. Pat. No. 4,490,711 discloses a timing device specifically described as useful for keeping track of times for taking medication. According to Johnston, the user can only shut off the alarm when the alarm is sounding. This particular invention records the number of times during which the alarm has come on and the user has responded to the alarm by silencing it.

Backner, U.S. Pat. No. 5,157,640 discloses a medication alert watch which is programmable by use of a communication link in the watch with a special cradle at a pharmacist's office. The pharmacist utilizes a computer link to the cradle to program medication dosage and identification and time for taking the medicine. Multiple medicines and dose times are enabled by the invention. When the medicine is to be taken, an audible tone sounds until the alarm and medication display are disabled by pressing a button.

A drawback to the alarms known in the art is that once an alarm event occurs, the alarm can be canceled by the user. This presents the real possibility that users who consider the alarm a mere annoyance will cancel the alarm and not take the indicated action. Further, there is a need in the art for an alarm that allows acknowledgment of an alarm event only after an alarm control has been inactive for a period of time. That is, the prior art enables users to cancel an alarm event if the alarm has been accidentally manipulated, such as being sat on or activated accidentally by some other means. Thus, there is a need in the art for providing an alarm device which enables a user to acknowledge the alarm without turning off the alarm during an alarm event. It, therefore, is an object of this invention to provide an improved two-stage alarm, such as a medication watch, for enabling the user to acknowledge an alarm event by selecting a second attenuated stage during an alarm event without turning off the alarm.

SHORT STATEMENT OF THE INVENTION

Accordingly, the two-stage alarm of the present invention includes a clock generator. A memory device for storing data is connected to the clock generator. A data display device is connected to the memory device for displaying stored data. An alarm is connected to the memory device with a first stage and a second attenuated stage. An alarm control device is connected to the alarm for selecting the second attenuated stage during an alarm event. In a further embodiment, the alarm control device also includes an alarm event acknowledgment device for acknowledging an alarm event when the alarm control device is inactive. In a further embodiment, the alarm event acknowledgment device includes a lock-out delay loop that prevents the alarm acknowledgment from acknowledging an alarm event until the alarm control device has been inactive for a preselected period of time. In still further embodiments of the alarm, the data display includes a scrolling alpha-numeric display so that the alarm owner's identification can be scrolled across the face of the alarm. Other alpha-numeric displays include not only the owner's name identification but also medication requirements.

A still further embodiment of the invention includes a battery test circuit in the alarm. A connection port is connected to the battery test circuit and a host computer system is connected to the connection port for providing a reference signal to the alarm for comparing the reference signal to a signal from an alarm battery to the battery test circuit. The host computer may also include an input device for receiving owner identification, medication requirements and the like, as well as an output device for sending selected owner data to the memory device through the connection port. Additionally, the preferred embodiment of the invention includes alarms which consist of audio, visual, and/or tactile alarms.

A corresponding method of providing a two-stage alarm is also disclosed and claimed more fully and particularly hereafter.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
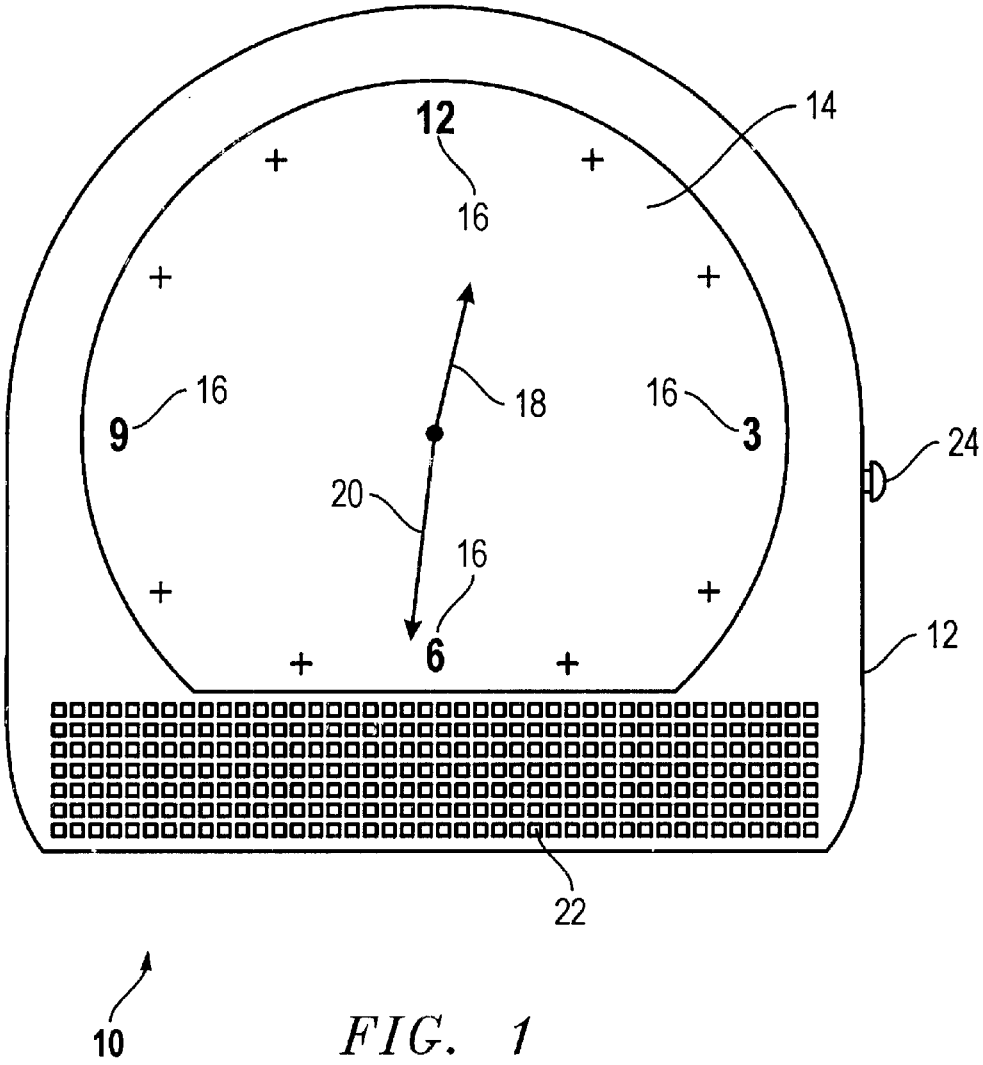
FIG. 1 is a front view of a preferred embodiment of the two-stage alarm of the present invention illustrating the alarm face.

The preferred embodiment of the present invention is illustrated by way of example in FIGS. 1–6. Referring to FIG. 1, two-stage alarm 10 includes body 12 with alarm face 14. Alarm face 14 includes standard hour indicators 16 as well as hour hand 18 and minute hand 20. FIG. 1 discloses analog hour hand 18 and minute hand 20. A digital time presentation may also be provided.

Alarm face 14 also includes liquid crystal display (LCD) 22. LCD 22 is utilized to present the alpha-numeric message appropriate to a particular alarm event. Importantly, LCD 22 is utilized to first display the owner's name in a scrolling pattern upon the occasion of an alarm event. By way of this function of two-stage alarm 10, misappropriation, misidentification, and misuse of two-stage alarm 10 is greatly decreased. That is, individual owners of these alarms 10, by means of LCD 22, are easily assured that it is their alarm 10 and therefore, for example, their own medication schedule being followed. Again, in a preferred embodiment, the first message displayed when the alarm 10 of the present invention is activated is the user's/owner's name.

FIG. 1 also discloses alarm control button 24. External alarm control button 24 is connected internally to the alarm 10. In the absence of an alarm event, alarm control button 24 is used to activate the alpha-numeric display on LCD 22 as will be disclosed more fully hereafter. During an alarm event, however, alarm control button 24 when utilized selects the second, attenuated, stage of two-stage alarm 10. At the start of an alarm event, the first stage alarm is the full unadulterated alarm. That is to say the full audio, visual or tactile alarm is presented at the beginning of an alarm event. Thereafter, the utilization of alarm control button 24 during an alarm event enables the user only to attenuate the alarm by selecting the second attenuated stage. That is, depressing alarm control button 24 during an alarm event lowers the sound level, decreases the intensity of the vibration, or lowers the light level of the visual stimulant from the higher first stage level. Depression of alarm control button 24, however, does not cancel an alarm event. In fact, by way of the present invention two-stage alarm 10 may not be disabled by the depression of alarm control button 24 during an alarm event. Particularly for a preferred embodiment of the invention for use with medication alarms with elderly patients or ADHD children, this feature of the invention is critical. It prevents the inadvertent cancellation of an alarm event upon the occurrence of alarm event which is likely to be thereafter forgotten or not understood completely. The second stage attenuated alarm of the present invention insures that the user continues to receive audio, visual and/or tactile alarm information for a protracted period of time after the beginning of an alarm event. This greatly enhances the probability that the indicated alarm action will in fact be accomplished.

Another feature of two-stage alarm 10 is that alarm control button 24 can acknowledge the occurrence of an alarm event after a preselected period of time has passed during an alarm event either in the first or second attenuated stage. So long as the alarm control button 24 has been inactive for the required period of time during an alarm event, thereafter the alarm control button 24 can be utilized to acknowledge the alarm event and return the two-stage alarm 10 to its starting position prior to the alarm event. In a preferred embodiment, a lock-out delay loop prevents the alarm control button 24 from acknowledging an alarm event until the alarm control button 24 has been inactive for a preselected period of time. The purpose of this feature of two-stage alarm 10 is to insure that the alarm event is acknowledged intentionally. In many cases, users of medication alarms, watches and the like, may inadvertently activate alarm control button 24 by placing the watch on a chair or sofa next to them and then sitting on it or placing a heavy object on it thereby continuously depressing alarm control button 24. In the prior art, this acknowledges alarm events that in fact had been unrecognized by the users so that the required alarm event action, i.e., take medication, is not accomplished.

Figure 2:
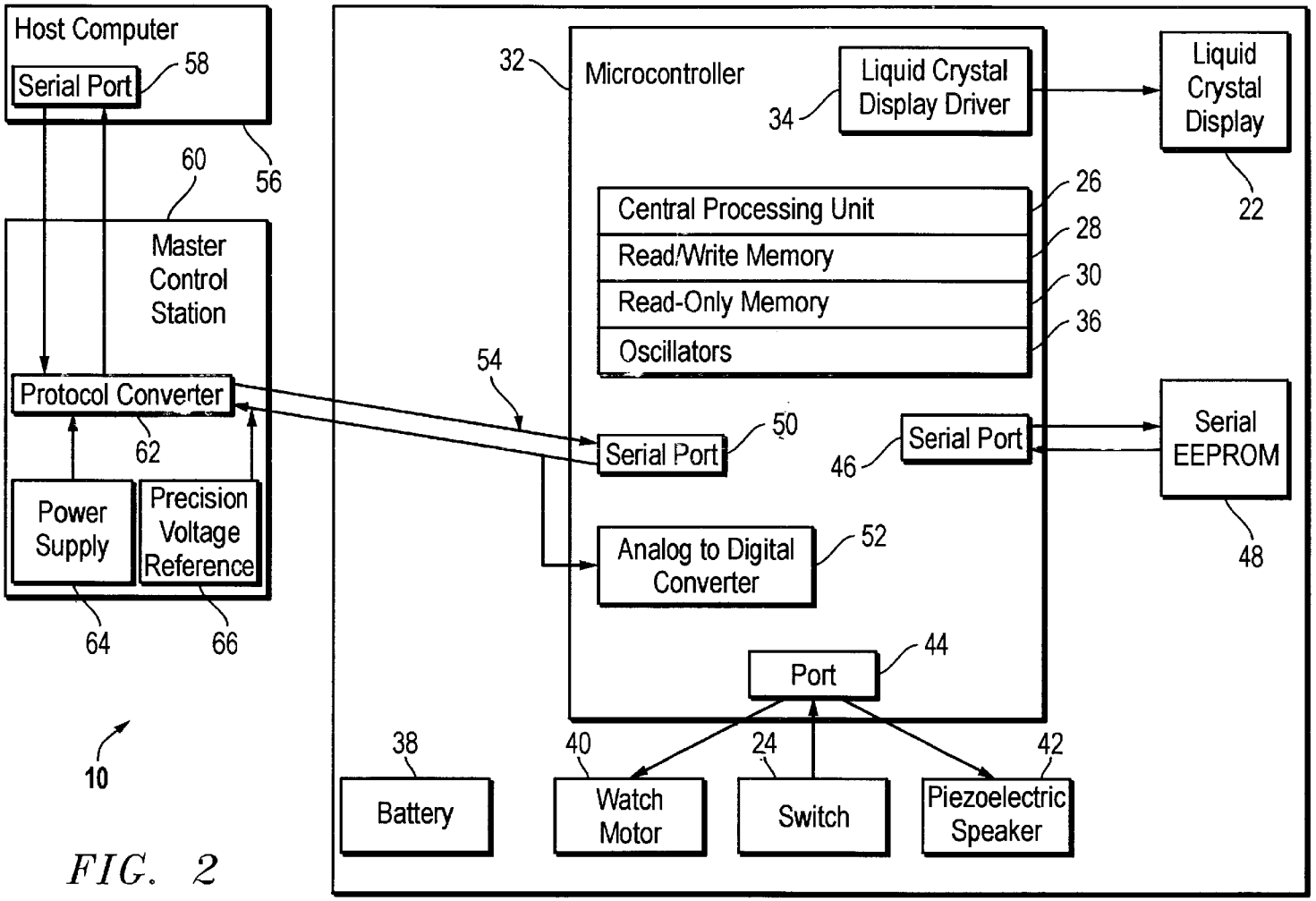
FIG. 2 is a schematic diagram of the two-stage alarm of the present invention connected to a host computer.

Referring now to FIG. 2, the inner-workings of two-stage alarm 10 are illustrated by way of a schematic. Two-stage alarm 10 includes, in a preferred embodiment, a central processing unit 26, read write memory 28, read-only memory 30, and micro controllers 32. Also shown is liquid crystal display driver 34 connected to LCD 22. Oscillator/clock generator 36 is illustrated along with battery 38. Alarm motor 40, control button 24, and electric speaker 42 are connected to micro controller 32 through port 44. Also illustrated is serial port 46 connected to serial EEPROM 48 for storing information. Also illustrated are serial port 50 and analog to digital convertor 52. As disclosed more fully hereafter, serial port 50 and analog to digital convertor 52 form connection port 54 with external host computer 56. Host computer 56 is any personal computer, main frame computer or the like now known or hereafter developed which also includes, in this embodiment, a serial port 58 for connection either externally or internally to a master control station 60 which includes protocol convertor 62 connected to power supply 64 and precision voltage reference 66. Protocol convertor 62 is connected to connection port 54 thereby providing a battery check for two-stage alarm 10 as will be more fully disclosed and discussed hereafter.

Figure 3:
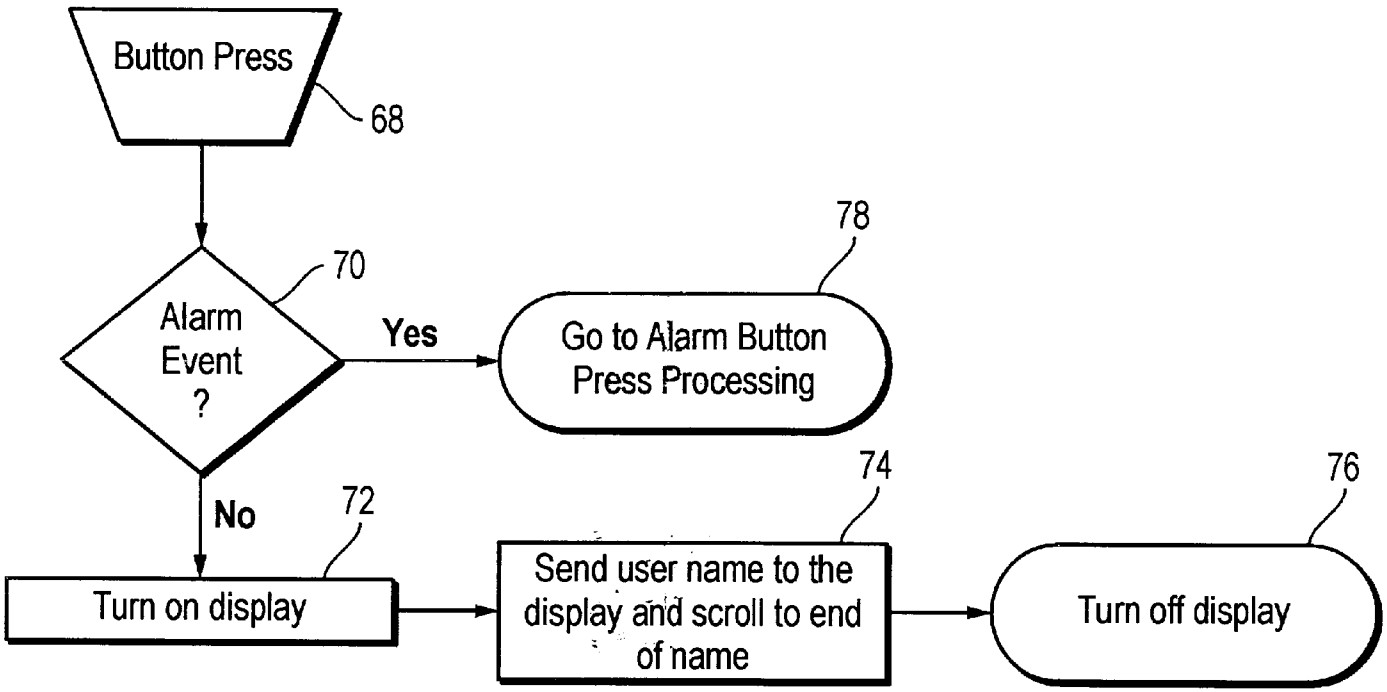
FIG. 3 is a flow diagram illustrating the owner's name scrolling function of the present invention.
Figure 4:
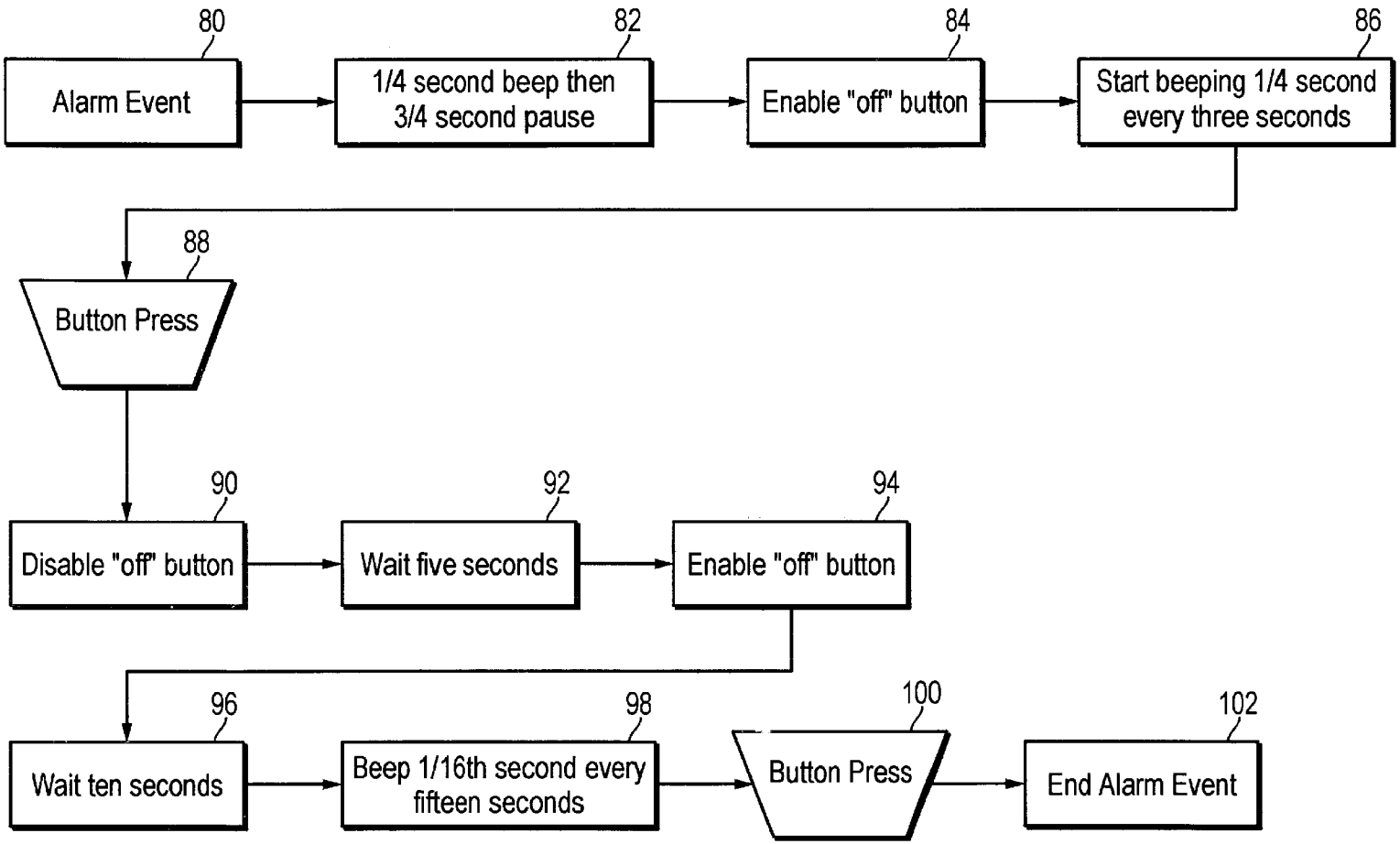
FIG. 4 is a flow diagram illustrating the activation of the second attenuated stage of the two-stage alarm of the present invention.

Referring now to FIG. 3, a flow diagram illustrates the effect of the operation or activation of alarm control button 24. When alarm control button 24 is depressed at block 68 central processing unit (CPU) 26 queries, in block 70, whether it is an alarm event. If the answer is "yes", CPU 26 proceeds to alarm button pressed processing as illustrated in FIG. 4 hereafter. If the answer is "no", CPU 26 turns on alpha-numeric display in block 72 and, as the first step, sends the user's name to the LCD 22 and scrolls to the end of user's name in block 74. At the end of the scrolling of the user's name, CPU 26 turns off the display in block 76.

Referring now to FIG. 4, if the answer to the query as to alarm event in block 70 is "yes", CPU 26 goes to alarm button pressed processing 78 as illustrated in FIG. 4. With the occurrence of an alarm event in block 80 the alarm event functions as follows. Block 82 results in a one-quarter second beep then a three-quarter second pause. Thereafter the "off" button is enabled in block 84, enabling the user to activate alarm control button 24 during the first stage of alarm event 80. Thereafter two-stage alarm 10 starts beeping one-quarter second every three seconds in block 86. In addition to the audio signal the appropriate message symbol is scrolled visually beginning with the user's name. Likewise, a tactile, vibratory or the like, signal can be generated as well by any means now known in the art or hereafter developed. In block 88, if during this first stage alarm, alarm control button 24 is pressed, two-stage alarm 10 disables the off button in block 90 and passes into the second stage of two-stage alarm 10 wherein the alarm is attenuated. Attenuation stage 16 can be for any period of time. Block 92 suggests five seconds, but the lock out at this stage can be for any period of time appropriate for an individual user or situation. After the passage of the preselected lock out delay in block 92 alarm control button 24 is enabled in block 94. Thereafter, a waiting period is provided in block 96. Waiting period 96, when added to waiting period 92 is equal to fifteen seconds similar to block 98. The waiting period in block 96 is followed by commencement of a continued alarm beep one-sixteenth of a second every fifteen seconds in block 98 until alarm control button 24 is pressed again in block 100 thereby acknowledging and ending the alarm event in block 102. Once again, during an alarm event 80, alpha-numeric messages are displayed through LCD 22 appropriate to the alarm event, beginning by first identifying the owner and then identifying the medication and dosage to be taken or any other appropriate message.

Figure 5:
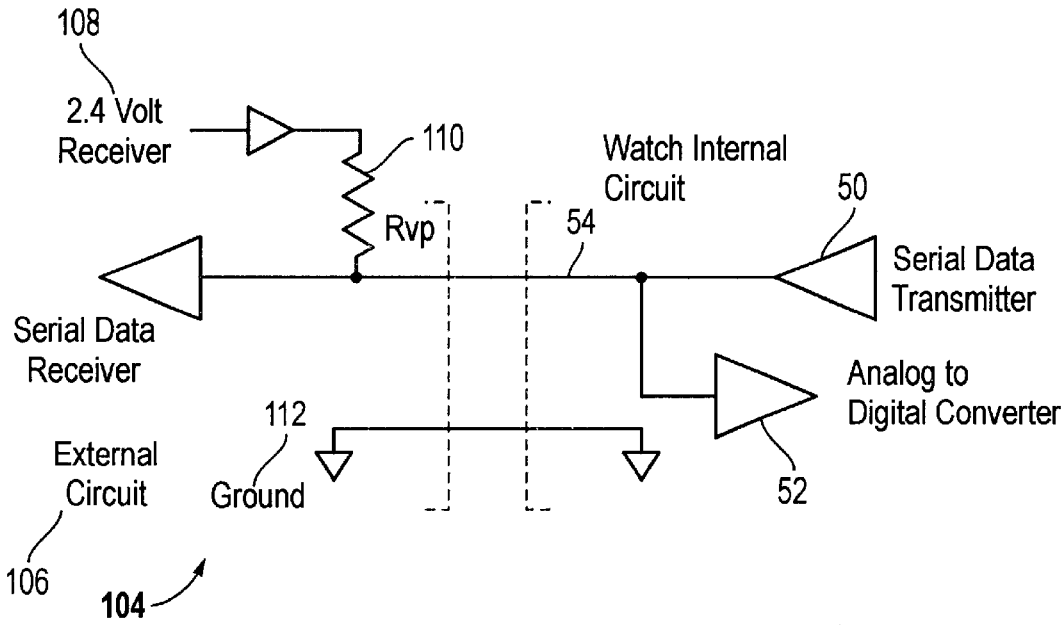
FIG. 5 illustrates battery test circuit of the present invention.

Referring now to FIG. 5, the battery tester 104 of the present invention is illustrated. Battery tester 104 of the present invention includes an external circuit 106. External circuit 106 provides a fixed precision reference voltage 108, such as 2.4 volts as illustrated. Through a moderately high impedance 110, such as Rvp equals 22 K Ohms, battery tester 104 is connected to two-stage alarm 10 through connection port 54. During serial transmission, reference voltage 108 does not affect the operation because the impedance of its resistor Rvp 110 is more than 100 times greater than the typical output impedance of this serial data transmitter. This mode of operation is referred to as serial communications mode.

When a battery test is performed in two-stage alarm 10, it switches its low-impedance serial data transmitter amplifier drivers to high-impedance by way of CPU 28. In this situation, the serial data transmitter does not affect operation because its impedance is more than 100 times greater than the impedance of resistor Rvp 110. By this mechanism, precision reference voltage 108 is allowed to set the voltage of the serial communications line at a time that it is controlled by this internal alarm circuit. Again, this mode of operation is referred to as the battery test mode. As illustrated in FIG. 5, both circuits are connected to ground 112.

When two-stage alarm 10 is in the battery test mode, the analog to digital converter 52 is used to determine the voltage of this serial communication line relative to the converter's power supply. If the battery 38 is fully charged, the converter power supply voltage will be higher than the reference voltage 108 on the serial communications line. In this case, the initial voltage of a fully charged battery 38 will exceed three volts. As the alarm battery voltage decreases with age and use, the converter's power supply decreases accordingly. Eventually, the converter's power supply declines until it is lower than the input reference voltage 108 as seen on the serial communications line. At that time, the converter input voltage will be seen as "full scale", being greater than or equal to the battery voltage. The value of the precision reference voltage 108 in a preferred embodiment has been set to a voltage that will allow detection of a low battery condition long before the battery 38 fails. As illustrated in FIG. 5, the battery 38 will fail at 2 volts and the reference voltage 108 is set at 2.4 volts. Whenever the converter detects that the reference voltage 108 is equal to or greater than the battery supply voltage (the reference voltage is at full scale), two-stage alarm 10 CPU 26 signals to the user by mean of LCD 22 that the battery 38 must be replaced.

This mechanism has many advantages over the prior art. It allows the battery 38 to be tested without the need for an internal precision reference voltage generator. This reduces the cost, space, weight and power consumption requirements. Further, this mechanism allows secondary use of an analog to digital converter 52 that may already be a component in the alarm but being used for other purposes. This is possible because when the two-stage alarm 10 of the present invention is not connected to external circuit 106, there is no serial data transmission and there is no precision reference voltage 108. Thus, the converter's input node may be connected to any other circuit in the alarm 10 as long as that circuit is disabled during serial communications mode and during alarm test mode.

While the preferred embodiment shows the precision voltage battery tester 104 connected to an analog to digital converter 52, a simpler circuit may also be substituted for the analog to digital converter 52, such as a voltage comparator. In the case of a voltage comparator, one side of the voltage comparator is connected to the battery voltage and the other side is connected to the serial communications line. At the time that the battery voltage declines below the reference voltage level, the comparator switches polarities in a manner that may be sensed by other digital circuits in the alarm 10 and utilized to generate a low battery signal.

Figure 6:
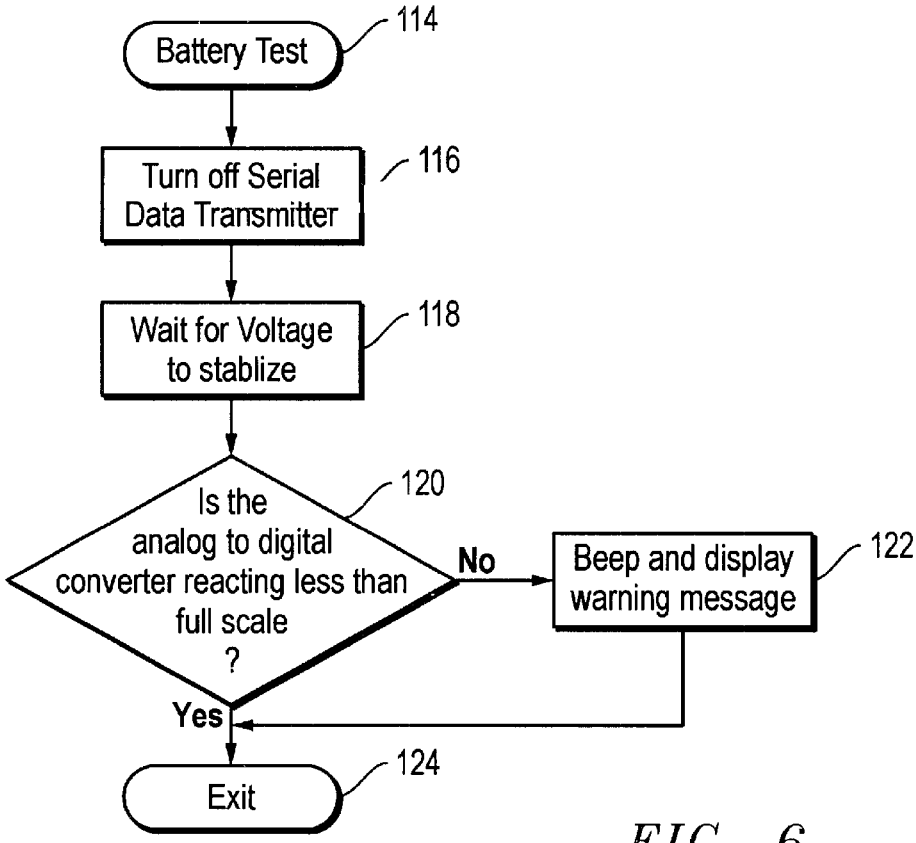
FIG. 6 is a flow diagram of the battery test function of the present invention.

Referring now to FIG. 6, the flow diagram for the battery test procedure of the present invention is illustrated wherein battery test is selected in block 114. When selected, CPU 26 turns off serial data transmitter 50 in block 116 and waits for voltage to stabilize in block 118. At that point, CPU 26 queries in block 120 if the analog to digital convertor 50 is reading less than full scale. If "no", the program continues to block 122 where an audio and visual "low battery" warning message is displayed and then the program exits at block 124. If the answer is "yes" in block 120, the battery test is complete having found the battery 38 to be sufficient and the program exits again at block 124.

It should be understood that two-stage alarm 10 of the present invention can be utilized for any desired alarm event. Not only may two-stage alarm 10 provide medication alarms, both repetitive and single shot, but also habit control (HC) alarms. When utilized for habit control, two-stage alarm 10 of the present invention provides for the user's dosage pattern to be controlled by a sequence of watch alarms. By way of example, when two-stage alarm 10 of the present invention is used for habit control of smoking. The alarm will first indicate when a cigarette is to be smoked, allowing the user to turn off the first alarm, yet be reminded gently until the cigarette is smoked. This two step process helps to ensure that the indicated activity is performed and it also strengthens the association between the habitual behavior and the watch operation. Further the two-stage alarm 10 of the present invention can take any convenient form such as a stand alone alarm, a watch alarm, a pager alarm and so forth. Thus, it is also safe to say that while the two-stage alarm 10 of the present invention has been disclosed in connection with medication alarms, it should be appreciated that the alarm system can be used in other manners. As a result, while the present invention has been disclosed in connection with the preferred embodiment thereof, it should be understood that there may be other embodiments which fall within the spirit and scope of the invention as defined by the following claims.

What is claimed is:

1. A two stage alarm comprising:

(a) a clock generator;

(b) a memory means for storing data connected to said clock generator;

(c) a data display means connected to said memory means for displaying stored data;

(d) an alarm connected to said memory means with a first stage and a second attenuated stage; and (e) an alarm control means connected to said alarm for selecting said second attenuated stage during an alarm event.

2. The alarm of claim 1 wherein said alarm control means further comprises an alarm event acknowledgment means for acknowledging an alarm event when said alarm control means is inactive.

3. The alarm of claim 2 wherein said alarm event acknowledgment means includes a lockout that prevents said alarm acknowledgment means from acknowledging an alarm until said alarm control means has been inactive for a preselected period of time.

4. The alarm of claim 1 wherein said data display means comprises a scrolling alpha-numeric display.

5. The alarm of claim 4 wherein upon an alarm event, the first alphanumeric display is the alarm owner name.

6. The alarm watch of claim 5 wherein said alpha-numeric display further comprises medication data.

7. The alarm of claim 1 further comprising:

(a) input means for receiving owner identification, medication and habit control data; and (b) output means for sending selected owner data to said memory means.

8. The alarm of claim 1 further comprising:

(a) a battery test circuit;

(b) a connection port connected to said battery test circuit; and (c) a host computer means connected to said connection port for providing a reference signal to said alarm for comparing said reference signal to a signal from an alarm battery through said battery test circuit.

9. The alarm of claim 1 wherein said alarm further comprises audio, visual, and tactile alarms.

10. In a device with an alarm for providing the device owner information concerning the owner's medication needs, a two stage alarm comprising:

(a) a clock generator;

(b) a memory means connected to said clock generator for storing owner identification and medication data;

(c) a data display means connected to said memory means for displaying said stored data;

(d) said two stage alarm connected to said memory means comprising a first alarm stage and an attenuated second alarm stage; and (e) an alarm control means connected to said two stage alarm for selecting said attenuated second alarm stage during an alarm event.

11. The alarm of claim 10 wherein said data display means comprises a scrolling alpha-numeric display.

12. The alarm of claim 11 wherein the alarm owner's identification is the first data displayed upon the occurrence of an alarm event.

13. The alarm of claim 10 further comprising:

(a) a battery test circuit;

(b) a connection port connected to said battery test circuit; and (c) a host computer means connected to said connection port for providing a reference signal to said two stage alarm watch for comparing said reference signal to a signal from an alarm watch battery through said battery test circuit.

14. The alarm of claim 10 further comprising:

(a) input means for receiving owner identification, medication, and habit control data; and (b) output means for sending selected owner data to said memory means.

15. The alarm of claim 10 wherein said alarm further comprises audio, visual, and tactile alarms.

16. A method for providing an owner of an alarm device medication data comprising the steps of:

(a) providing a clock generator in said device;

(b) connecting memory means to said clock generator for storing owner identification and medication data within said alarm device;

(c) inputting said owner identification and medication data to said memory means;

(d) connecting a data display means to said memory means for displaying said input data in response to preselected data display times set in said memory means;

(e) connecting a two stage alarm to said memory means with a first alarm stage and an attenuated second alarm stage;

(f) connecting an alarm control means to said two stage alarm for selecting said attenuated second alarm stage during an alarm event; and (g) activating said clock generator.

17. The method of claim 16 wherein the step of connecting a data display means further comprises the step of providing a scrolling, alpha-numeric display of the alarm owner's identification upon the occurrence of an alarm event.

18. The method of claim 16 wherein the step of connecting a two stage alarm further comprises the step of providing a two stage alarm with audio, visual, and tactile alarms.

19. The method of claim 16 wherein the step of connecting an alarm control means to said two stage alarm further comprises the step of controlling said alarm in the absence of an alarm event after said alarm control means has been inactive for a preselected period of time.

20. The method of claim 16 further comprising the steps of:

(a) providing a battery test circuit in said alarm;

(b) attaching a connection port to said battery test circuit;

(c) connecting a host computer to said connection port and providing a reference signal to said alarm device through said battery test circuit; and (d) comparing said reference signal to a signal from an alarm device battery.

* * * * *